US011833533B2

(12) United States Patent
Lee et al.

(10) Patent No.: US 11,833,533 B2
(45) Date of Patent: Dec. 5, 2023

(54) PUMP CONTAINER

(71) Applicants: Kyeong Sook Kim, Anyang-si (KR); F.S.KOREA INDUSTRIES INC., Seoul (KR)

(72) Inventors: Young Joo Lee, Anyang-si (KR); Ji Hoon Lee, Gimpo-si (KR); Dae Sik Seo, Anyang-si (KR)

(73) Assignees: Kyeong Sook Kim, Anyang-si (KR); F.S.KOREA INDUSTRIES INC., Seoul (KR)

( * ) Notice: Subject to any disclaimer, the term of this patent is extended or adjusted under 35 U.S.C. 154(b) by 26 days.

(21) Appl. No.: 17/630,035

(22) PCT Filed: Aug. 18, 2020

(86) PCT No.: PCT/KR2020/010937
§ 371 (c)(1),
(2) Date: Jan. 25, 2022

(87) PCT Pub. No.: WO2021/034064
PCT Pub. Date: Feb. 25, 2021

(65) Prior Publication Data

US 2022/0280958 A1 Sep. 8, 2022

(30) Foreign Application Priority Data

Aug. 19, 2019 (KR) ..... 10-2019-0101216

(51) Int. Cl.
*B05B 11/00* (2023.01)
*B05B 11/10* (2023.01)

(52) U.S. Cl.
CPC ..... *B05B 11/0037* (2013.01); *B05B 11/1002* (2023.01); *B05B 11/1052* (2023.01); *B05B 11/1073* (2023.01)

(58) Field of Classification Search
CPC ..... B05B 11/0037; B05B 11/1002; B05B 11/1052; B05B 11/1073; B05B 11/1001;
(Continued)

(56) References Cited

U.S. PATENT DOCUMENTS 6,223,954 B1 * 5/2001 Carow ..... G01F 11/028 222/340
10,010,897 B2 * 7/2018 Espinoza ..... B05B 11/106
(Continued)

FOREIGN PATENT DOCUMENTS

JP 08-511988 A 12/1996
KR 20-0255127 Y1 12/2001
(Continued)

*Primary Examiner* — Vishal Pancholi
(74) *Attorney, Agent, or Firm* — NKL LAW; Jae Youn Kim

(57) ABSTRACT

A pump container includes: a container in which a liquid is contained; a shoulder member configured as a cylindrical member, the upper and lower portions of which are open, the shoulder member having a lower outer peripheral portion formed to have an inner diameter larger than that of an upper inner peripheral portion; a valve housing comprising a cylinder portion, a hose being inserted/connected into/to the lower portion of the cylinder portion, the upper portion of the cylinder portion being open, the valve housing comprising an outer-periphery cylinder portion configured on the outer peripheral edge of the cylinder portion in a flared shape, the upper portion of the outer-periphery cylinder portion being open, the valve housing comprising an upper-end insertion portion bent outwards, and the valve housing comprising a seating portion bent outwards from the upper end of the upper-end insertion portion and a discharge cap.

5 Claims, 8 Drawing Sheets

(58) Field of Classification Search
CPC ..... B05B 11/1059; B05B 11/1074; B05B 11/1077; B05B 11/1023
See application file for complete search history.

(56) References Cited

U.S. PATENT DOCUMENTS

| | | | | |
|---|---|---|---|---|
| 2015/0136810 | A1* | 5/2015 | Ding | B05B 11/1074 222/321.9 |
| 2017/0021376 | A1* | 1/2017 | Espinoza | B05B 11/106 |

FOREIGN PATENT DOCUMENTS

| | | | |
|---|---|---|---|
| KR | 20-0428943 | Y1 | 10/2006 |
| KR | 10-0780902 | B1 | 11/2007 |
| KR | 20-2014-0001455 | U | 3/2014 |
| KR | 10-2044128 | B1 | 11/2019 |
| WO | 01-78903 | A1 | 10/2001 |

* cited by examiner

PUMP CONTAINER

TECHNICAL FIELD

The present disclosure relates to an eco-friendly pump container employing a cylindrical corrugated-tube spring made of elastic plastic instead of a metal spring that is an important part of a pump. In more detail, the present disclosure relates to a pump container that can be recycled even without separate waste collection unlike the existing metal spring, which should be separately collected, by using a cylindrical corrugated-tube spring made of plastic, and that can maintain the elastic restoration ability of the plastic spring by employing the way of locking by rotating a discharge cap with the plastic spring expanded rather than employing the existing way of locking by pressing a discharge cap.

BACKGROUND ART

Containers filled with fluid-state daily items that are widely used in normal life are equipped with a small manual pump and the inside substance is discharged by a predetermined amount when the pumps are pressed, so users can easily use the inside substance.

Such a pump device is called a 'dispenser', and when the pump is pressed, the inside substance in the chamber inside the pump is discharged outside through a nozzle.

However, when the force pressing the pump is removed, the pump is returned up by elastic restoration force of the spring installed between the container and the pump and the inside substance in the container is suctioned into the chamber inside the pump.

Such a dispenser is used for various products including a shampoo container and is used to easily discharge the shampoo in a container by a predetermined amount.

In the related art, a cap covered with a lid and having an outlet for discharging shampoo is used, but it is inconvenient to press the shampoo container to use the shampoo. Accordingly, at present, most shampoo containers are equipped with a dispenser because of the structural advantage of conveniently discharging shampoo and preventing a waste of shampoo by suppressing excessive discharge.

There is a dispenser manufactured to the above purpose in the related art (Korean Utility Model No. 20-0428943).

Referring to FIG. 8, a dispenser 100 of the related art include: a container 20 in which liquid is kept; a housing 22 that is fixed downward to the opening of the container 20 and has a negative pressure hole; a hollow shaft 24 that is moved up and down in the housing 22 when it is pressed by a user; a piston 24 that is connected to the lower portion of the shaft 23 and pressurizes or depressurizes the inside of the housing 22; a nozzle head 31 that communicates with the shaft 23 and is fixed to the upper portion of the shaft 23; a chaplet 26 that is fixed to the upper end of the housing 22 and is positioned between the housing 22 and the shaft 23; and a spring 25 that is positioned inside the housing 22 and has an upper end being in contact with the lower end of the piston 24, in which a discharge hole for securing inflow/outflow of air is formed between the shaft 23 and the chaplet 26.

According to the dispenser of the related art, since, in pumping, the inside substance at the end of the tube 30, that is, the lowermost end should be pumped up, so the pumping force is insufficient and the possibility of poor pumping is high. Further, there is a problem, particularly, when the viscosity of the inside substance is high, pumping is more difficult, so the force of discharging the inside substance is low and it is difficult to press the button. Further, since the spring 25 made of metal is disposed in the housing 22 and is always in contact with the liquid in the container, there is possibility of deterioration of the liquid due to corrosion of the spring 25. Further, there is a problem that since the dispenser has excessive parts, the manufacturing cost is high. Further, there is a problem that since the metallic spring and plastic components are assembled, the dispenser cannot be recycled when it is discarded.

DISCLOSURE

Technical Problem

The present disclosure has been made to the technical requests in the related art and an objective of the present disclosure is to provide an eco-friendly pump container that is configured such that when a discharge cap is pressed, a cylindrical corrugated-tube spring is folded, a piston is moved down, the volume inside a housing decreases, and the inside substance is discharged outside, and when the discharge cap is released, the cylindrical corrugated-tube spring stretches, the piston connected to the discharge cap moves up, and the inside substance is returned into the housing, that is manufactured at a low cost because it has a small number of parts, that enables plastic to be recycled because it does not employ a metal spring.

Technical Solution

A pump container according to a first embodiment of the present disclosure includes: a container in which liquid is kept; a shoulder member that is a cylindrical member being open on the top and bottom and having a larger inner diameter at a lower outer circumferential portion than an upper inner circumferential portion and of which the inner surface of the lower outer circumferential portion is thread-fastened to an upper opening of the container; a valve housing that has a cylinder part connected with a hose for suctioning an inside substance in the container at a lower portion thereof and being open on the top, an outer cylindrical part extending outward from the outer circumference of the cylinder part and being open on the top, an upper end insertion part bending outward from the upper end of the outer cylindrical part, being in close contact with the inner wall of the container, and inserted in the upper inner circumferential portion of the shoulder member, and a seating part bending outward from the upper end of the upper end insertion part and seated on the top of the upper opening of the container; a discharge cap that is a cylindrical member coupled to the lower end of the upper inner circumferential portion of the shoulder member to move up and down and discharges the inside substance by operating a pump member installed at the center of the lower portion thereof when the discharge cap is pressed; and a cylindrical corrugated-tube sprint that is made of plastic and inserted between the inner top of the discharge cap and the bottom of the outer cylindrical part of the valve housing.

The discharge cap has a discharge nozzle protruding at an end of the upper end thereof so that an inside substance is discharged through a space communicating with a cylindrical piston of the pump body, and has locking members on two sides of the lower end of the outer circumference, that is, at positions that are symmetric to each other.

The locking step has a slit vertically cut from the body of the discharge cap, a locking portion protruding outward from the lower end to be locked to the bottom of the outer inner circumferential portion of the shoulder member, and a circular protrusion circumferentially protruding upward from the center of the upper portion of the locking portion and inserted in a groove formed on the bottom of the outer inner circumferential portion.

Vertical passages are formed at positions that are symmetric to each other that are two sides of the outer circumference of the outer cylindrical part of the valve housing, and an anti-rotation protruding wall preventing rotation of the discharge cap is formed on a wall forming the vertical passage, that is, an inner wall of the upper end insertion part.

Advantageous Effects

Since the pump container of the present disclosure employs a cylindrical corrugated-tube spring made of plastic, it is an eco-friendly product. That is, in the related art using metal springs, when pump containers are discarded, they are wasted without be recycled because the metal springs are difficult to separate, but a spring made of plastic is used in the present disclosure, the container can be recycled without separately collecting the spring.

Further, in the related art, pump containers are released with a metal spring compressed (a metal spring is compressed by pressing a discharge cap of pump containers when the pump containers are released in the related art).

Accordingly, users have to remove the force compressing the spring when using pump containers after the pump containers are released, so the elastic restoration force of the metal spring is decreased because the metal spring has been compressed for a long time. However, according to the pump container of the present disclosure, since the discharge cap is not locked by pressing, but is locked by turning at 90 degrees with a plastic spring expanded, there is an effect that the elastic restoration force of the plastic spring is not decreased even for a long time.

BEST MODE

Hereinafter, preferred embodiments of the present disclosure will be described with reference to the accompanying drawings so that those skilled in the art can easily achieve the present disclosure.

Figure 1:
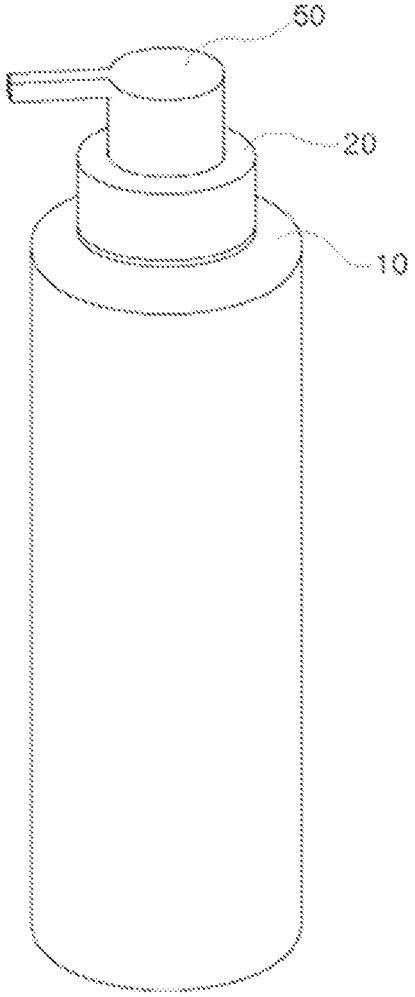
FIG. 1 is a perspective view showing the external appearance of a pump container according to a first embodiment of the present disclosure.
Figure 2:
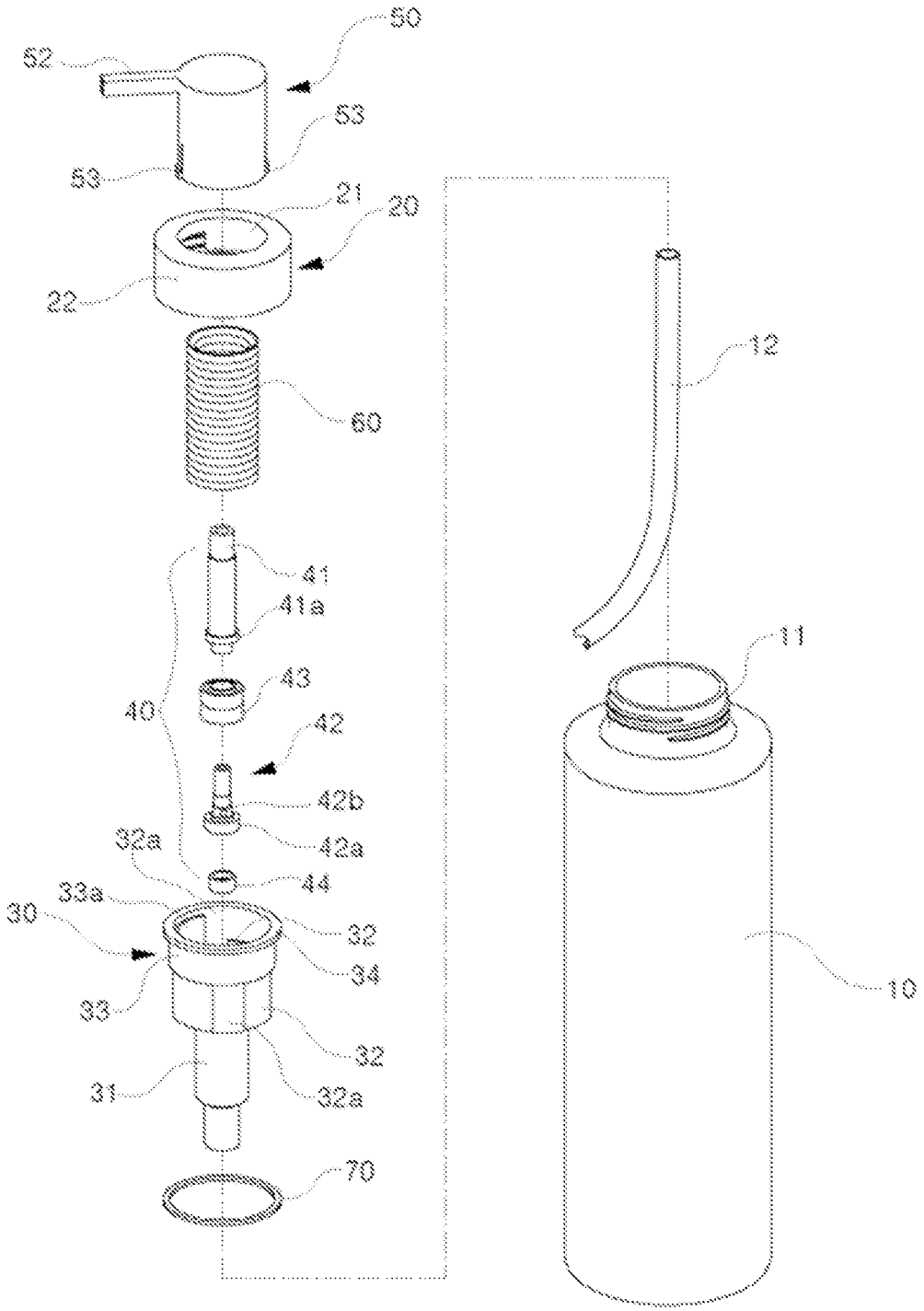
FIG. 2 is an exploded perspective view showing the pump container according to the first embodiment of the present disclosure.
Figure 3:
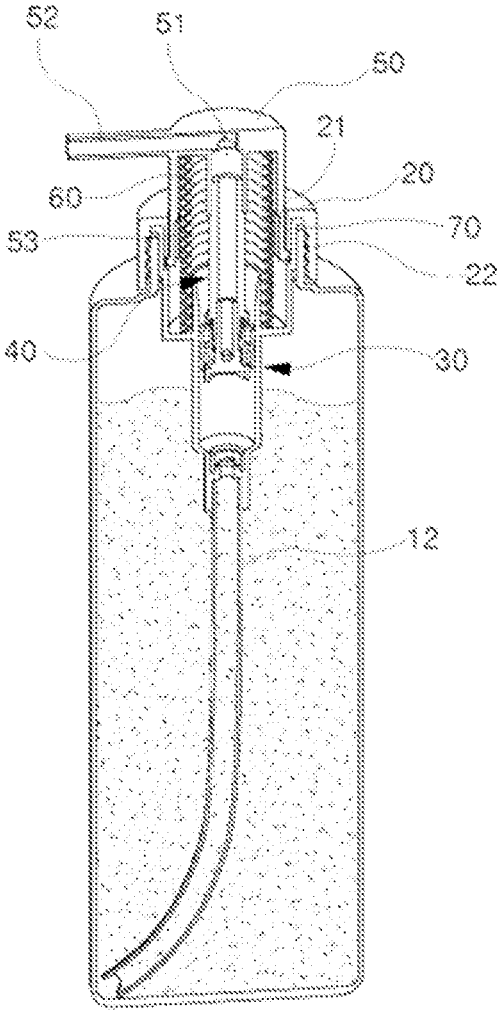
FIG. 3 is a cross-sectional view of the assembly of the pump container according to the first embodiment of the present disclosure.
Figure 4:
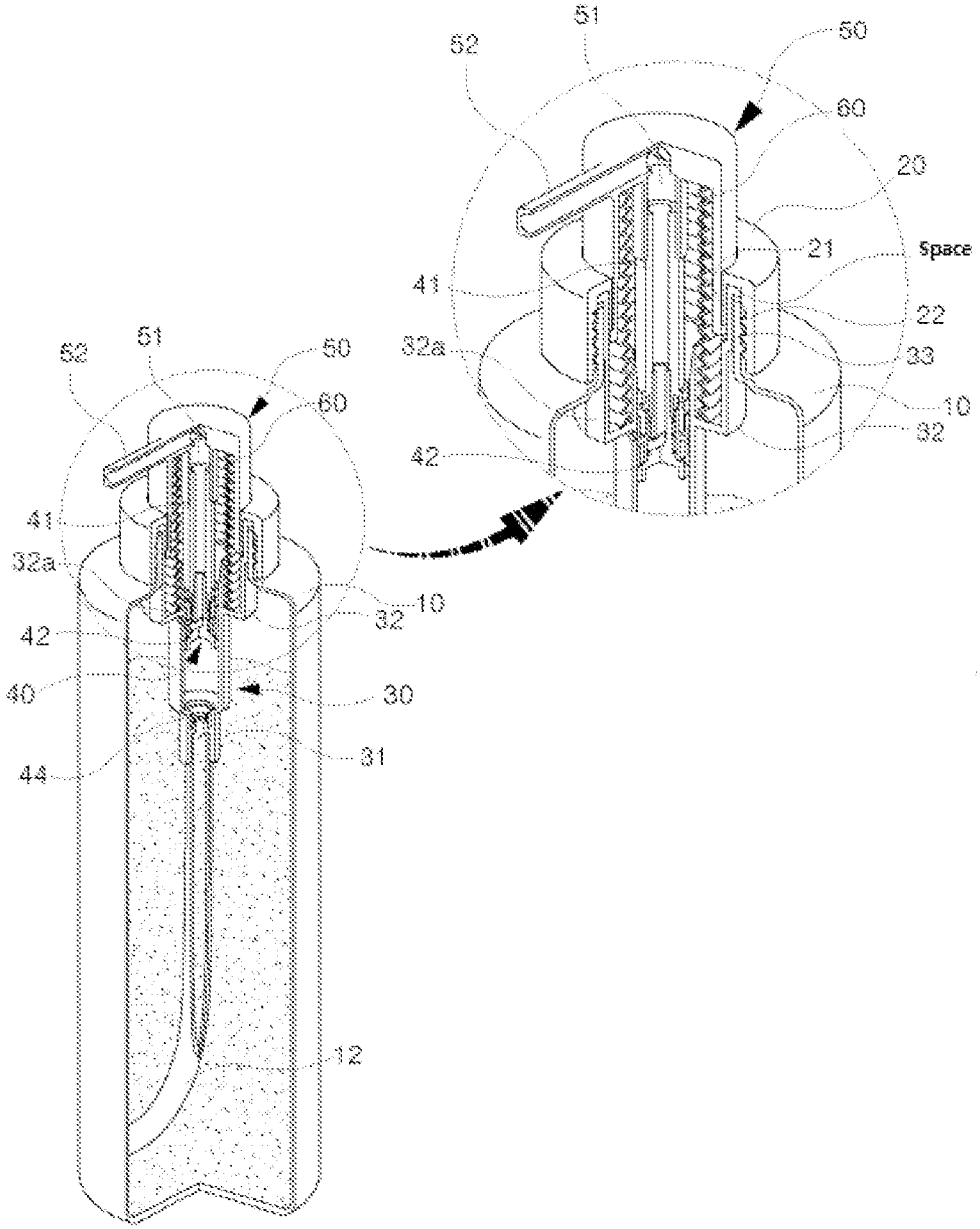
FIG. 4 is a cross-sectional view when the pump container according to the first embodiment of the present disclosure is opened.
Figure 5:
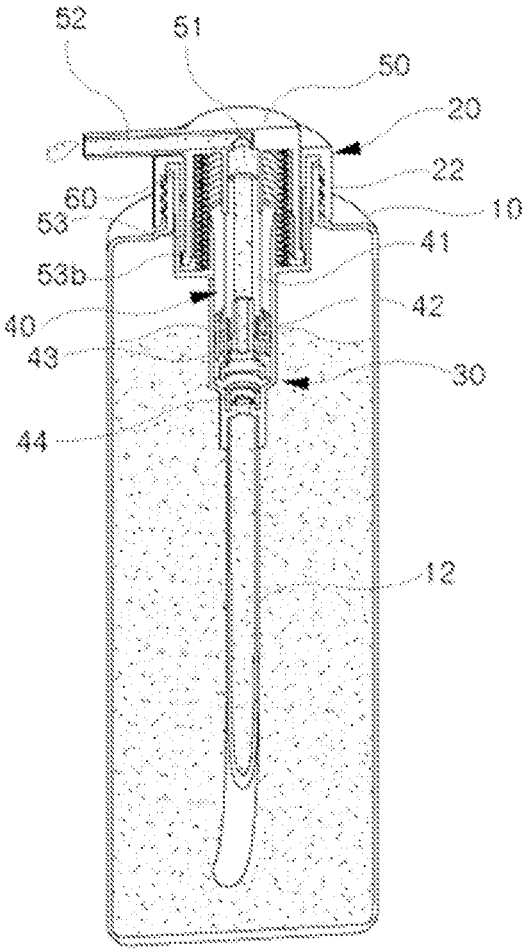
FIG. 5 is a cross-sectional view showing the state in which the inside substance is discharged when the pump container according to the first embodiment of the present disclosure is pressed.
Figure 6:
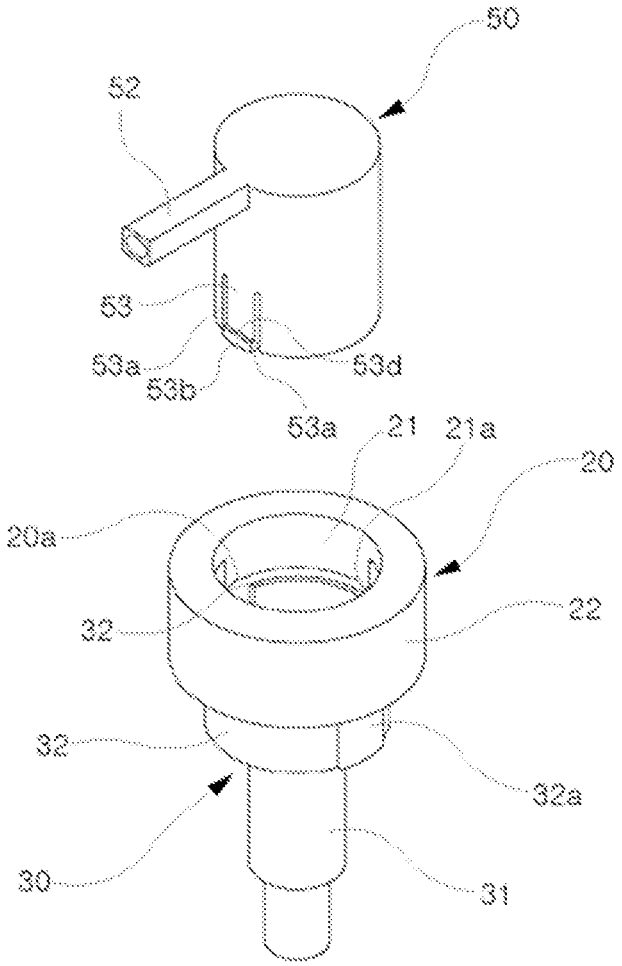
FIG. 6 is an exploded perspective view showing a container cap according to the first embodiment of the present disclosure.
Figure 7:
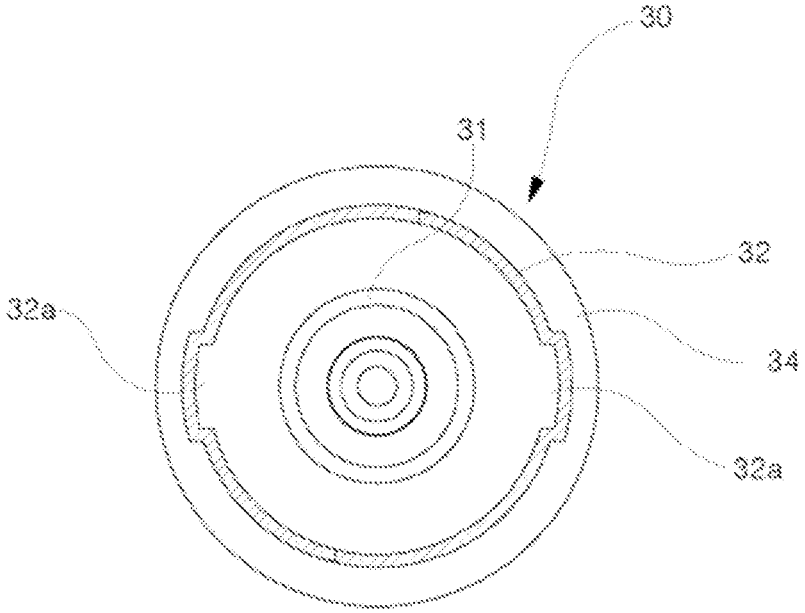
FIG. 7 is a plan view showing a valve housing of the present disclosure.
Figure 8:
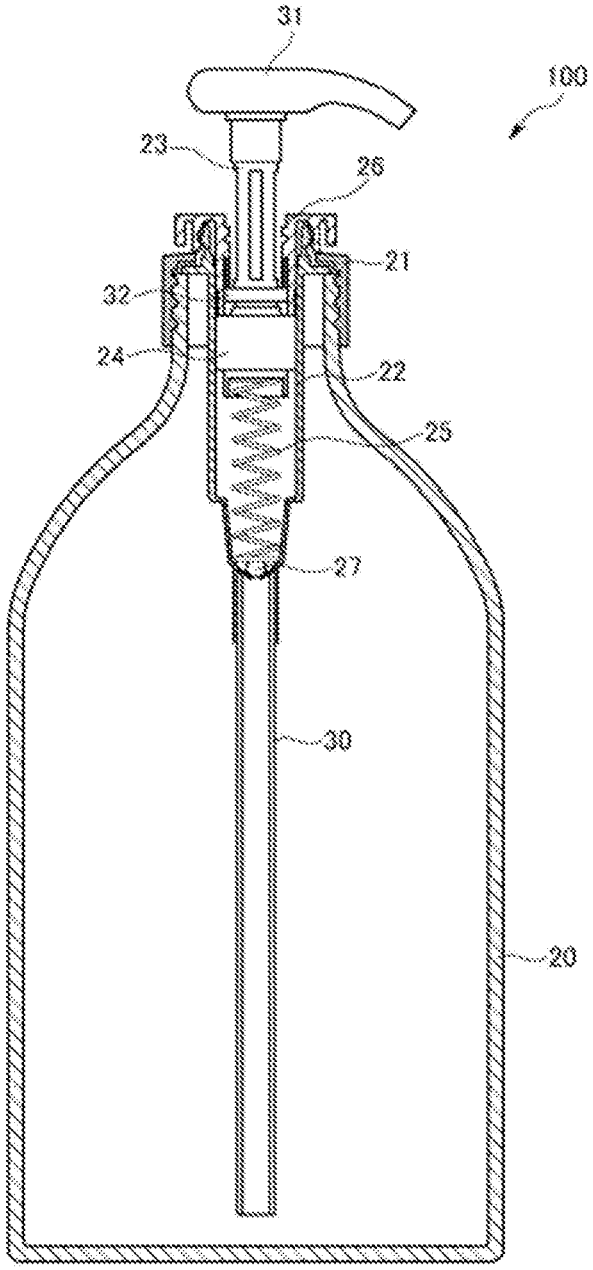
FIG. 8 PRIOR ART
FIG. 8 is a cross-sectional view showing a pump container of the related art.

FIG. 1 is a perspective view showing the external appearance of a pump container according to a first embodiment of the present disclosure, FIG. 2 is an exploded perspective view showing the pump container according to the first embodiment of the present disclosure, FIG. 3 is a cross-sectional view of the assembly of the pump container according to the first embodiment of the present disclosure, FIG. 4 is a cross-sectional view when the pump container according to the first embodiment of the present disclosure is opened, FIG. 5 is a cross-sectional view showing the state in which the inside substance is discharged when the pump container according to the first embodiment of the present disclosure is pressed, FIG. 6 is an exploded perspective view showing a container cap according to the first embodiment of the present disclosure, and FIG. 7 is a plan view showing a valve housing of the present disclosure.

As shown in FIGS. 1 to 7, a pump container according to a first embodiment of the present disclosure includes: a container 10 in which liquid is kept; a shoulder member 20 that is a cylindrical member being open on the top and bottom and having a larger inner diameter at a lower outer circumferential portion 22 than an upper inner circumferential portion 21 and of which the inner surface of the lower outer circumferential portion 22 is thread-fastened to an upper opening 11 of the container 10; a valve housing 30 that has a cylinder part 31 connected with a hose 12 for suctioning an inside substance in the container 10 at a lower portion thereof and being open on the top, an outer cylindrical part 32 extending outward from the outer circumference of the cylinder part 31 and being open on the top, an upper end insertion part 33 bending outward from the upper end of the outer cylindrical part 32, being in close contact with the inner wall of the container 10, and inserted in the upper inner circumferential portion 21 of the shoulder member 20, and a seating part 34 bending outward from the upper end of the upper end insertion part 33 and seated on the top of the upper opening 11 of the container 10; a discharge cap 50 that is a cylindrical member coupled to the lower end of the upper inner circumferential portion 21 of the shoulder member 20 to move up and down and discharges the inside substance by operating a pump assembly 40 installed at the center of the lower portion thereof when the discharge cap 50 is pressed; and a cylindrical corrugated-tube sprint 60 that is made of plastic and inserted between the inner top of the discharge cap 50 and the bottom of the outer cylindrical part 32 of the valve housing 30.

A space (see FIG. 4) is formed between the upper inner circumferential portion 21 and the lower outer circumferential portion 22 and the upper opening 11 is fitted in the space.

The valve housing 30 has: a cylinder part 31 connected with a hose 12 for suctioning an inside substance in the container 10 at a lower portion thereof and being open on the top; an outer cylindrical part 32 extending outward from the outer circumference of the cylinder part 31 and being open on the top; an upper end insertion part 33 fitted in the space, bending outward from the upper end of the outer cylindrical part 32, being in close contact with the inner wall of the container 10, and inserted in the upper inner circumferential portion 21 of the shoulder member 20; and a seating part 34 fitted in the space, bending outward from the upper end of the upper end insertion part 33 and seated on the top of the upper opening 11 of the container 10.

The discharge cap 50 has a discharge nozzle 52 protruding from an end of the upper end thereof so that the inside substance is discharged through a space 51 communicating with the cylindrical piston 41 of the pump assembly 40.

The cylindrical corrugated-tube spring 60 is any one selected from a corrugated bellows spring or a ring type spring having a shape in which a ring is wound.

The pump assembly 40, which is a well-known pump assembly, includes: a pipe-shaped cylindrical rod 41 of which the upper portion is inserted at the center in the discharge cap 50 and that has an outer circumferential protrusion 41*a* formed at the lower portion thereof; a piston 42 that is a cylindrical member coupled to the lower end of the cylindrical rod 41, is open at the upper portion, has a closing portion 42*a* closing the upper portion at the lower portion thereof, and has several intake holes 42*b* on the upper outer circumference of the closing portion 42*a*; and an opening/closing packing member 43 that is a cylindrical member inserted inside the outer circumferential surface of the piston 42 and of which the outer circumferential surface opens/closes the intake hole 42*b* of the piston 42 while moving up and down in close contact with the inner circumferential surface of the cylinder part 31.

The discharge cap 50 has locking steps 53 on two sides of the lower end of the outer circumference, that is, at positions that are symmetric to each other. The locking step 53 has a slit 53*a* vertically cut from the body of the discharge cap 50, a locking portion 53*b* protruding outward from the lower end to be locked to the bottom of the outer inner circumferential portion 21 of the shoulder member 20, and a circular protrusion 53*c* circumferentially protruding upward from the center of the upper portion of the locking portion 53*b* and inserted in a groove 21*a* formed on the bottom of the outer inner circumferential portion 21.

Vertical passages 32*a* are formed on two sides of the outer circumference, that is, at positions that are symmetric to each other of the outer cylindrical part 32 of the valve housing 30, and an anti-rotation protruding wall 33*a* preventing rotation of the discharge cap 50 is formed on a wall forming the vertical passage 32*a*, that is, on the inner wall of the upper end insertion part 33.

Reference numeral '70' not stated above indicates a circular packing positioned on the top of the upper opening 11 of the container 10 to be sealed with the shoulder member 20.

The operation of the pump container according to the first embodiment of the present disclosure described above is described hereafter.

First, when a user holds the discharge cap 50 and turns the discharge nozzle 52 in one direction to use the pump container, a pair of locking members 53 of the discharge cap 50 are rotated along the top of the outer cylindrical part 32 and then stopped by being locked to the anti-rotation protruding walls 33*a*. Further, the pair of locking members 53 are positioned in the vertical passages 32*a* formed by a side of the outer cylindrical part 32 and a side of the anti-rotation protruding walls 33*a*.

When the discharge cap 30 is vertically pressed with the locking members 53 positioned in the vertical passages 32*a*, the cylindrical rod 41 and the piston 42 are moved down and the opening/closing packing member 43 being in close contact with the inner circumference of the cylinder part 31 is moved down along the inner wall of the cylinder part 31 by the cylindrical rod 41.

As the opening/closing packing member 43 is moved down in this way, the volume inside the cylinder part 31 decreases and a check valve 44 for a pump is opened, so the inside substance flows into the cylinder part 31 and is simultaneously discharged to the discharge nozzle 52 through the intake holes 42*b* of the piston 42.

When the user releases the discharge cap 50 after discharging and using the inside substance in this way, the compressed cylindrical corrugated-tube spring 60 expands and lifts the discharge cap 50.

As the discharge cap 50 is lifted, the piston 42 is moved up and the check valve 44 is opened again, so the cylinder part 31 is filled with the inside substance.

After the discharge cap 50 is fully lifted, the discharge cap 50 is turned and the circular protrusions 53*c* of the locking members 53 of the discharge cap 50 are inserted into the groove 21*a* at the lower end of the upper inner circumferential portion 21 of the shoulder member 20, the discharge cap 50 stops rotating. In this state, the discharge cap 50 is not moved down even though it is pressed, that is, the bottom of the locking portions 53*b* of the locking members 53 are locked to the top of the outer circumferential part 32 of the valve housing 30, so the discharge cap 50 is not moved down.

The cylindrical corrugated-tube spring 60 made of plastic is inserted between the inner top of the discharge cap 50 and the bottom of the outer circumferential part 32 of the valve housing 30 to elastically support the discharge cap 50.

As described above, since the pump container of the present disclosure employs a cylindrical corrugated-tube spring made of plastic, it is an eco-friendly product. That is, in the related art using metal springs, when pump containers are discarded, they are wasted without be recycled because the metal springs are difficult to separate, but a spring made of plastic is used in the present disclosure, the container can be recycled without separately collecting the spring.

Further, in the related art, pump containers are released with a metal spring compressed (a metal spring is compressed by pressing a discharge cap of pump containers when the pump containers are released in the related art).

Accordingly, users have to remove the force compressing the spring when using pump containers after the pump containers are released, so the elastic restoration force of the metal spring is decreased because the metal spring has been compressed for a long time. However, according to the pump container of the present disclosure, since the discharge cap is not locked by pressing, but is locked by turning at 90 degrees with a plastic spring expanded, there is an effect that the elastic restoration force of the plastic spring is not decreased.

Although detailed embodiments of the present disclosure were described above, it is apparent that the present disclosure may be easily modified by those skilled in the art, and such modified embodiments are included in the spirit of the present disclosure described in claims.

The invention claimed is:

1. A pump container comprising:

a container in which liquid is kept and that has an upper opening and an inner wall;

a shoulder member that is a cylindrical member being open on the top and bottom and having a larger inner diameter at a lower outer circumferential portion of the shoulder member than an upper inner circumferential portion of the shoulder member and of which an inner surface of the lower outer circumferential portion of the shoulder member is thread-fastened to the upper opening of the container;

a valve housing that has a cylinder part connected with a hose for suctioning an inside substance in the container at a lower portion thereof and being open on the top, an outer cylindrical part extending outward from an outer circumference of the cylinder part of the valve housing and being open on the top, an upper end insertion part bending outward from an upper end of the outer cylindrical part of the valve housing, being in contact with the inner wall of the container, and inserted in the upper inner circumferential portion of the shoulder member, and a seating part bending outward from an upper end of the upper end insertion part and seated on the top of the upper opening of the container;

a discharge cap that is a cylindrical member coupled to a lower end of the upper inner circumferential portion of the shoulder member to move up and down and discharges the inside substance by operating a pump member installed at a center of the lower portion thereof when the discharge cap is pressed; and a cylindrical corrugated-tube spring that is made of plastic and inserted between an inner top of the discharge cap and a bottom of the outer cylindrical part of the valve housing to elastically support the discharge cap, wherein, after the discharge cap is fully lifted, when the discharge cap is turned and circular protrusions of locking members of the discharge cap are inserted into a groove at the lower end of the upper inner circumferential portion of the shoulder member, the discharge cap stops rotating, and in this state, even though the discharge cap is pressed, the discharge cap is not moved down because a bottom of locking portions of the locking members are locked to a top of the outer circumferential part of the valve housing, whereby elastic restoration force of the cylindrical corrugated-tube spring is not decreased because the discharge cap is locked by turning with the cylindrical corrugated-tube spring expanded.

2. The pump container of claim 1, wherein the discharge cap has a discharge nozzle protruding at an end of the upper end thereof so that an inside substance is discharged through a space communicating with a cylindrical piston of a pump assembly, and has locking members on two sides of the lower end of the outer circumference.

3. The pump container of claim 2, wherein each of the locking members has a slit vertically cut from a body of the discharge cap, a locking portion protruding outward from a lower end of the discharge cap to be locked to a bottom of the outer inner circumferential portion of the shoulder member, and a circular protrusion circumferentially protruding upward from a center of an upper portion of the locking portion and inserted in a groove formed on the bottom of the outer inner circumferential portion of the shoulder member.

4. The pump container of claim 2, wherein vertical passages are formed at positions that are symmetric to each other that are two sides of an outer circumference of an outer cylindrical part of the valve housing, and an anti-rotation protruding wall preventing rotation of the discharge cap is formed on a wall forming the vertical passages that is an inner wall of the upper end insertion part.

5. A pump container comprising:

a container in which liquid is kept and that has an upper opening and an inner wall;

a shoulder member that is a cylindrical member being open on the top and bottom and having a larger inner diameter at a lower outer circumferential portion of the shoulder member than an upper inner circumferential portion of the shoulder member, that has a space formed between the upper inner circumferential portion of the shoulder member and the lower outer circumferential portion of the shoulder member, and of which an inner circumference of the lower outer circumferential portion of the shoulder member is thread-fastened to the upper opening of the container with the upper opening fitted in the space;

a valve housing that has a cylinder part connected with a hose for suctioning an inside substance in the container at a lower portion thereof and being open on the top, an outer cylindrical part extending outward from an outer circumference of the cylinder part of the valve housing and being open on the top, an upper end insertion part fitted in the space, bending outward from the upper end of the outer cylindrical part of the valve housing, being in close contact with the inner wall of the container, and inserted in the upper inner circumferential portion of the shoulder member, and a seating part fitted in the space, bending outward from an upper end of the upper end insertion part, and seated on the top of the upper opening of the container;

a discharge cap that is a cylindrical member coupled to a lower end of the upper inner circumferential portion of the shoulder member to move up and down and discharges the inside substance by operating a pump member installed at a center of the lower portion thereof when the discharge cap is pressed; and a cylindrical corrugated-tube spring that is made of plastic and inserted between an inner top of the discharge cap and a bottom of the outer cylindrical part of the valve housing to elastically support the discharge cap, wherein, after the discharge cap is fully lifted, when the discharge cap is turned and circular protrusions of locking members of the discharge cap are inserted into a groove at the lower end of the upper inner circumferential portion of the shoulder member, the discharge cap stops rotating, and in this state, even though the discharge cap is pressed, the discharge cap is not moved down because a bottom of locking portions of the locking members are locked to a top of the outer circumferential part of the valve housing, whereby elastic restoration force of the cylindrical corrugated-tube spring is not decreased because the discharge cap is locked by turning with the cylindrical corrugated-tube spring expanded.

* * * * *